US009279295B2

(12) United States Patent
Williamson et al.

(10) Patent No.: US 9,279,295 B2
(45) Date of Patent: Mar. 8, 2016

(54) LINER FLOTATION SYSTEM

(75) Inventors: Scott Earl Williamson, Castle Rock, CO (US); Robert Christopher Stratton, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 590 days.

(21) Appl. No.: 13/536,078

(22) Filed: Jun. 28, 2012

(65) Prior Publication Data

US 2014/0000906 A1 Jan. 2, 2014

(51) Int. Cl.
*E21B 43/10* (2006.01)
*E21B 17/14* (2006.01)
*E21B 21/10* (2006.01)

(52) U.S. Cl.
CPC ..... *E21B 17/14* (2013.01); *E21B 21/10* (2013.01); *E21B 43/10* (2013.01)

(58) Field of Classification Search
CPC ..... E21B 17/14; E21B 21/10; E21B 47/10; E21B 34/14
USPC ..... 166/386, 373, 317, 318, 316
See application file for complete search history.

(56) References Cited

U.S. PATENT DOCUMENTS 2,212,086 A 8/1940 Thornhill
2,458,278 A 1/1949 Larkin
2,662,602 A 12/1953 Schnitter
3,526,280 A 9/1970 Aulick
3,527,299 A 9/1970 Lewis
3,572,432 A 3/1971 Aulick
4,384,616 A 5/1983 Dellinger
4,712,619 A 12/1987 Stepp et al.
4,986,361 A 1/1991 Mueller et al.
5,117,915 A 6/1992 Mueller et al.
5,150,756 A 9/1992 Hassanzadeh
5,174,375 A 12/1992 Mims et al.
5,181,571 A * 1/1993 Mueller et al. ..... 166/381
5,456,317 A 10/1995 Hood, III et al.
5,479,986 A 1/1996 Gano et al.
5,607,017 A 3/1997 Owens et al.
5,660,239 A 8/1997 Mueller (Continued)

FOREIGN PATENT DOCUMENTS

WO 2014198887 A1 12/2014

OTHER PUBLICATIONS

Canadian Office Action dated Feb. 19, 2015, for Canadian Patent Application No. 2,781,413.

(Continued)

*Primary Examiner* — Kenneth L Thompson
*Assistant Examiner* — David Carroll
(74) *Attorney, Agent, or Firm* — Patterson & Sheridan, L.L.P.

(57) ABSTRACT

A liner flotation system comprises a liner, a first valve, and a second valve configured to form a gas filled chamber within the liner. The first valve is operable to allow fluid flow into the chamber, and the second valve operable to allow fluid flow out of the chamber. A sleeve is disposed in the chamber, and the first valve is movable into engagement with the sleeve to provide an indication of a position of the first valve. A method of securing a liner in a well comprises lowering a liner having a gas filled chamber in the well, actuating a valve to open fluid flow into the chamber, removing the gas from the chamber, and moving the valve into engagement with a sleeve coupled to the liner to provide an indication of a position of the valve.

24 Claims, 10 Drawing Sheets

(56) References Cited

U.S. PATENT DOCUMENTS

| | | | | |
|---|---|---|---|---|
| 5,685,372 | A | 11/1997 | Gano | |
| 5,765,641 | A | 6/1998 | Shy et al. | |
| 5,829,526 | A | 11/1998 | Rogers et al. | |
| 5,924,696 | A | 7/1999 | Frazier | |
| 6,026,903 | A | 2/2000 | Shy et al. | |
| 6,076,600 | A | 6/2000 | Vick, Jr. et al. | |
| 6,142,545 | A | 11/2000 | Penman et al. | |
| 6,161,622 | A | 12/2000 | Robb et al. | |
| 6,220,350 | B1 | 4/2001 | Brothers et al. | |
| 6,253,857 | B1 | 7/2001 | Gano | |
| 6,431,276 | B1 | 8/2002 | Robb et al. | |
| 6,505,685 | B1 | 1/2003 | Sullaway et al. | |
| 6,622,798 | B1 | 9/2003 | Rogers et al. | |
| 6,634,430 | B2 | 10/2003 | Dawson et al. | |
| 6,651,748 | B2 | 11/2003 | Sullaway et al. | |
| 6,758,281 | B2 | 7/2004 | Sullaway et al. | |
| 7,093,664 | B2 | 8/2006 | Todd et al. | |
| 7,168,494 | B2 | 1/2007 | Starr et al. | |
| 7,182,135 | B2 | 2/2007 | Szarka | |
| 7,353,879 | B2 | 4/2008 | Todd et al. | |
| 7,549,479 | B2 | 6/2009 | Biegler et al. | |
| 7,584,792 | B2 | 9/2009 | Szarka | |
| 7,686,092 | B2 | 3/2010 | Szarka | |
| 7,712,521 | B2 | 5/2010 | Sorensen | |
| 7,789,162 | B2 | 9/2010 | Keller et al. | |
| 8,430,173 | B2 | 4/2013 | Todd et al. | |
| 8,430,174 | B2 | 4/2013 | Holderman et al. | |
| 8,434,559 | B2 | 5/2013 | Todd et al. | |
| 2004/0060709 | A1* | 4/2004 | Vidrine et al. | 166/380 |
| 2006/0124295 | A1* | 6/2006 | Maguire | 166/207 |
| 2011/0000676 | A1 | 1/2011 | Brandsdal | |
| 2014/0216756 | A1 | 8/2014 | Getzlaf et al. | |

OTHER PUBLICATIONS

Halliburton, "Halliburton Buoyancy Assisted Casing Equipment (BACETM) Assembly", 2006, 2 Pgs.

* cited by examiner

LINER FLOTATION SYSTEM

BACKGROUND OF THE INVENTION

1. Field of the Invention

Embodiments of the invention relate to a liner flotation system.

2. Description of the Related Art

It is often desirable in the oilfield industry to drill horizontal wells to produce oil and gas. These horizontal wells may be either cased holes or open holes. Longer horizontal well sections maximize oil and gas recovery and are thus in longer lengths.

However, these "extended reach" horizontal wells have become so long that it is difficult to get a liner to depth when both the liner and the well are full of fluid. In particular, the weight of the work string must be sufficient to provide a downward force that overcomes the frictional/drag force produced by the liner rubbing against the bottom of the horizontal well. When the conditions of the horizontal section of the well become severe enough to create a frictional force that cannot be overcome by the work string weight, the liner cannot be advanced any further into the well. This limitation hinders maximum recovery from oil and gas formations.

Recently, operators have preferred a "wet shoe" at the end of the liner. A wet shoe occurs when cement does not set around or obstruct a float valve (e.g. a check valve) at the end of the liner so that fluid flow remains established through the liner and float valve into the well. A wet shoe enables operators to conduct subsequent operations after cementing of the liner, such as pumping plugs or perforating guns to the toe of the well.

Therefore, there is a need for new and improved systems for running liners into horizontal wells and conducting subsequent well operations.

SUMMARY OF THE INVENTION

Embodiments of the invention include a liner flotation system comprising a liner, a first valve, and a second valve configured to form a chamber in the liner. The first valve is operable to allow fluid flow into the chamber, and the second valve operable to allow fluid flow out of the chamber. A sleeve is disposed in the chamber, and the first valve is movable into engagement with the sleeve to provide an indication of a position of the first valve.

Embodiments of the invention include a method of securing a liner in a well comprising lowering a liner having a chamber into the well, actuating a valve to open fluid flow into the chamber, supplying a fluid into the chamber, and releasing and moving the valve into engagement with a sleeve disposed in the chamber to provide an indication of a position of the valve.

BRIEF DESCRIPTION OF THE DRAWINGS

So that the manner in which the above recited features of the invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention relate to a system and method of positioning a liner in a horizontal well. The liner has a chamber filled with gas or other material to make the liner more buoyant as it is moved through the fluids in the well, which significantly reduces any drag force created by liner contact with the well surfaces. The chamber may be formed by a first valve and a second valve positioned on opposite ends of the liner. When the liner is in position, the gas filled chamber may be flooded with fluid. Fluid circulation may be established back to the surface, and the first valve may be pumped to the end of the liner. The liner may be secured and released in the well. Cement may be supplied to cement the liner in the well. After cementing the liner in the well, fluid flow through the end of the liner may be established to form a wet shoe for conducting subsequent operations.

Figure 1:
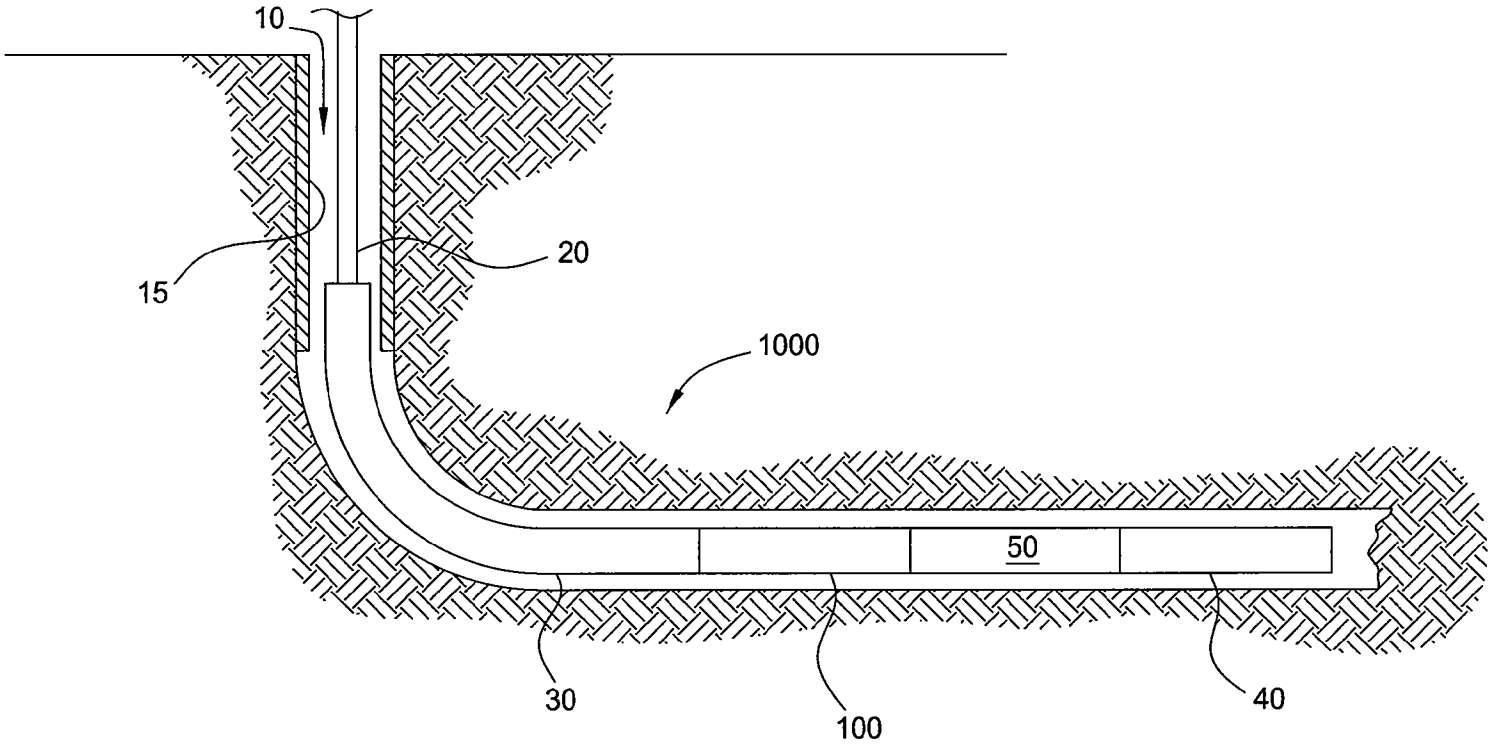
FIG. 1 schematically illustrates a liner flotation system in a well.

FIG. 1 illustrates a liner system 1000 lowered into a horizontal well 10 on a work string 20. The well 10 may have a cased portion 15, or may be an open hole. A liner hanger 30 is supported by the work string 20, and is operable to secure the system 1000 in the well 10. In one embodiment, the liner hanger 30 is configured to engage the lower end of the cased portion 15 of the well 10. In one embodiment, the liner hanger 30 may include a section of liner string extending from the liner hanger 30 above a first valve assembly 100 as further described below. The work string 20 and the liner hanger 30 may include and/or be operable with any conventional running/setting tools known in the art for securing liner hangers in wells. Embodiments of running/setting tools, liner hangers, plugs, and float valves/collars that may be used with the embodiments described herein are disclosed in U.S. Pat. Nos. 7,441,606, 7,225,870, 7,114,573, and 6,877,567, each disclosure of which is herein incorporated by reference in its entirety.

A first valve assembly 100 and a second valve assembly 40 are supported by the liner hanger 30 and form a chamber 50. The chamber 50 may be filled with a material having a density less than the density of the fluids in the well 10. The chamber 50 may be filled with a material so that the system 1000 is more buoyant as is it moved through the fluids in the well 10 to thereby reduce drag force created by liner contact with the well 10 surfaces. The material may include a gas, a liquid, a solid, or combinations thereof. The material may include air, nitrogen, light weight liquids or solids, foam, polystyrene, plastic, rubber, or combinations thereof. The system 1000 may include other types of buoyant devices and/or materials secured to one or more outer surfaces, inner surfaces, and/or disposed within and/or through one or more body portions of the system 1000. In one embodiment, a vacuum may be formed in the chamber 50. In one embodiment, one or more components of the system 1000, such as the chamber 50 or the liner 130 described below, may be formed from and/or filled with a material more buoyant than (having a density less than) fluids and/or other materials in the well 10. Although the chamber 50 is described herein as being filled with gas, the chamber 50 may be filled with the materials recited above and the system 1000 may be similarly operable as with the gas embodiments.

The first valve assembly 100 may initially prevent fluid flow into the chamber 50 when the system 1000 is lowered into the well 10. The second valve assembly 40 may be a one-way valve or a check valve, such as a float valve/collar. The second valve 40 may permit fluid flow out of the system 1000 and into the well 10, while preventing fluid flow into the system 1000 from the well 10.

Figure 2:
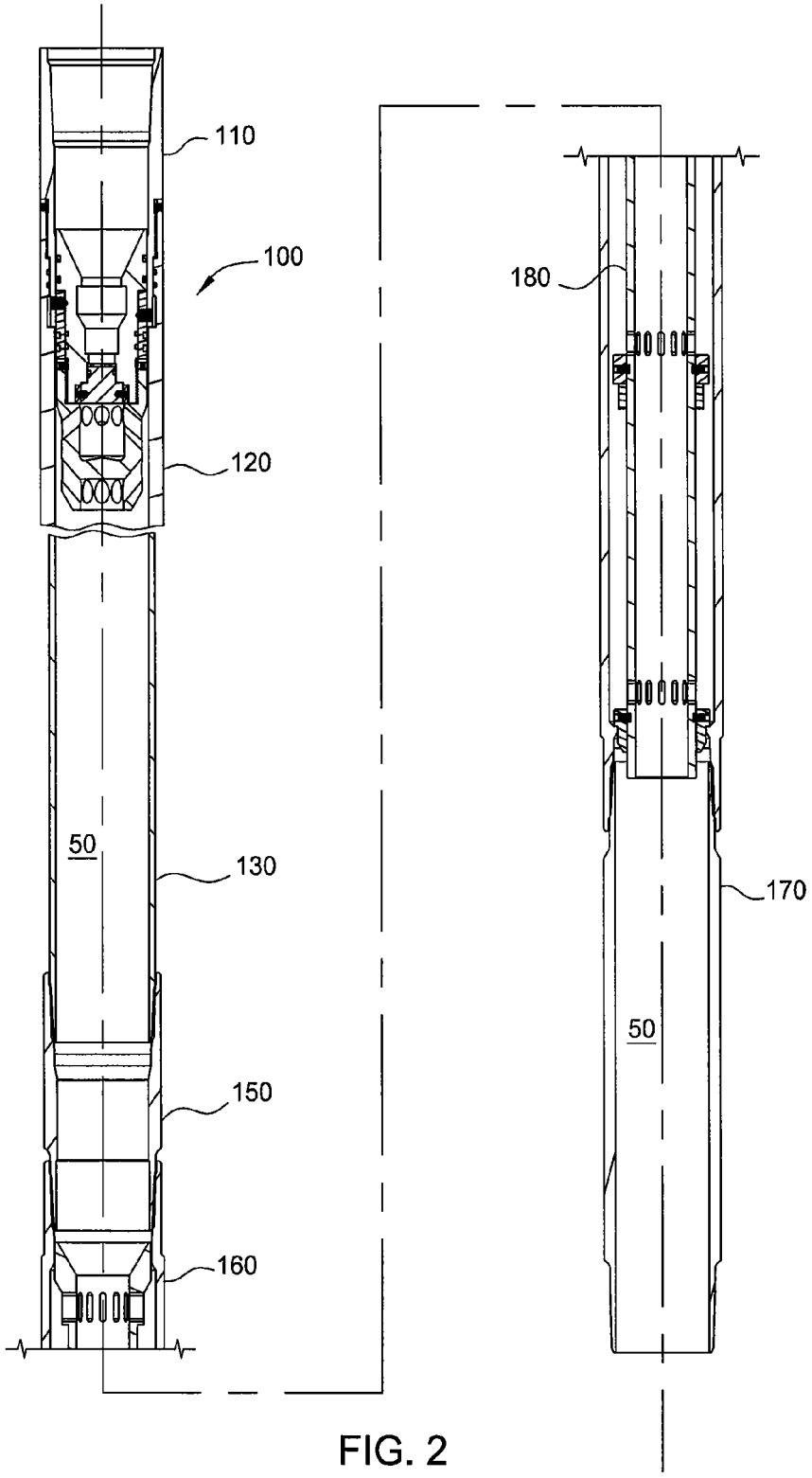
FIG. 2 illustrates a sectional view of the liner flotation system.

FIG. 2 illustrates the first valve assembly 100 disposed in an upper mandrel 110, and a mandrel 120 that is coupled to the upper mandrel 110. One or more seals 111, such as o-rings, may be disposed between the mandrels 110, 120. The upper mandrel 110 may be coupled to the liner hanger 30 as illustrated in FIG. 1. In one embodiment, the upper mandrel 110 may be coupled to a section of liner that extends from the liner hanger 30. The mandrel 120 may be coupled to a liner 130, which is coupled to a polished bore 150. The polished bore 150 may be coupled to a mandrel 160, which is coupled to a lower mandrel 170. The lower mandrel 170 may be coupled to the second valve assembly 40 illustrated in FIG. 1. The mandrels, liner, and/or polished bore may be coupled together using threaded, welded, and/or other type of connections known in the art. A sleeve 180 is disposed in the mandrel 160 and is further described below with respect to FIGS. 7-10.

The chamber 50 is formed between the first and second valve assemblies 100, 40. As illustrated in FIG. 2, the chamber 50 may be formed by the mandrel 120, the liner 130, the polished bore 150, the mandrel 160, and the lower mandrel 170. As noted above, the chamber 50 may be filled with gas or another material to make the system 1000 more buoyant as it is run into the well 10.

Figure 3:
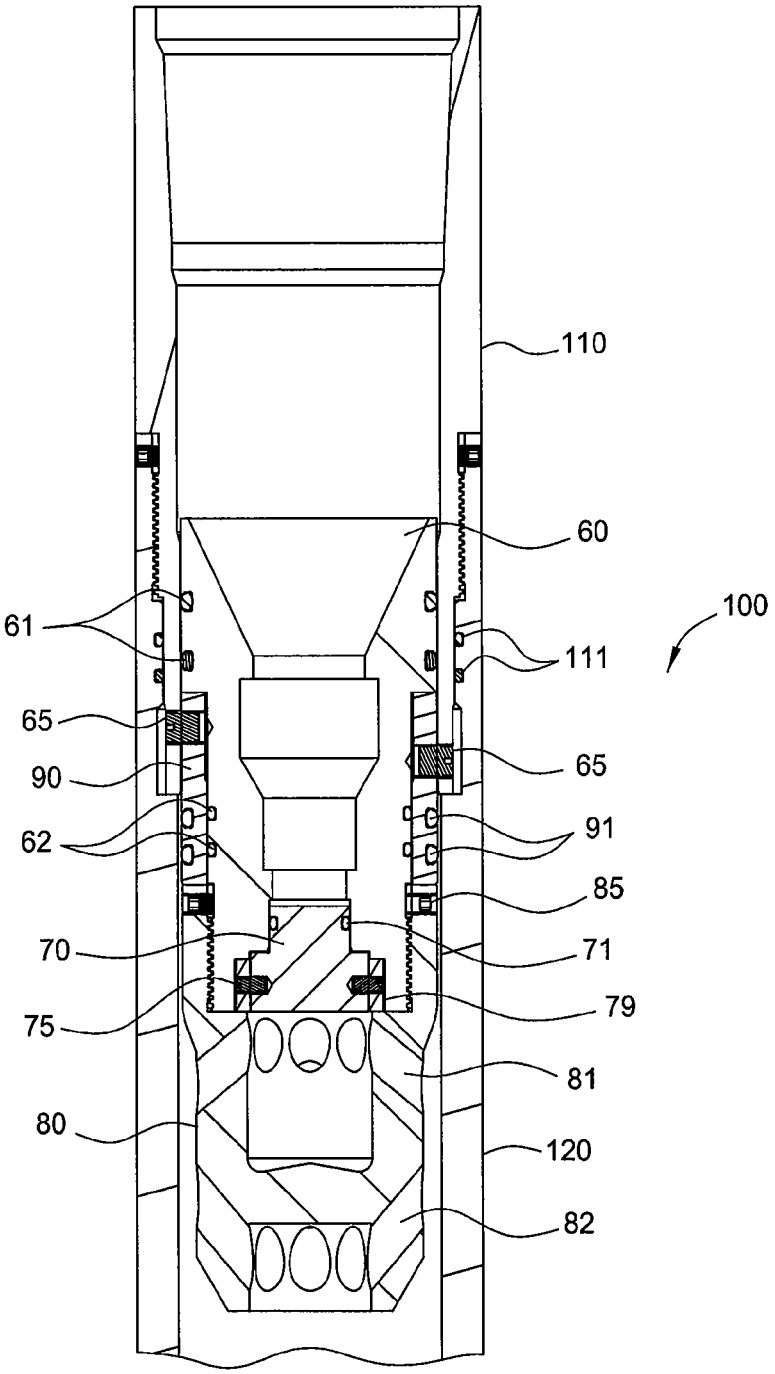
FIGS. 3-6 illustrate sectional views of a valve assembly of the liner flotation system.

FIG. 3 illustrates an enlarged sectional view of the first valve assembly 100 in the run-in position. The assembly 100 includes a first body 60 threadedly coupled to a second body 80, and a set screw 85 for preventing un-threading of the bodies. A plug 70 is disposed between the bodies 60, 80, and temporarily seals fluid communication between the bores of the bodies 60, 80. In one embodiment, the plug 70 is secured in the bore of the first body 60. The plug 70 temporarily prevents fluid communication with one or more flow paths 81, 82 disposed through the second body 80, and thus prevents fluid flow into the upper end of the chamber 50. At the opposite end, the second valve assembly 40 as illustrated in FIG. 1 prevents fluid flow into the lower end of the chamber 50.

A first support member 90, such as a ring, is coupled to the first body 60, and may be supported by a shoulder of the second body 80. A releasable connection 65, such as one or more shear pins, dogs, or collets, is disposed through the first support member 90 and the upper mandrel 110. In this manner, the first body 60 (and thus the second body) is releasably secured to the upper mandrel 110. In one embodiment, the first support member 90 may be formed from a material harder than the material of the first body 60. One or more seals 61, such as o-rings, are disposed between the first body 60 and the upper mandrel 110. One or more seals 62, such as o-rings, are disposed between the first body 60 and the first support member 90. One or more seals 91, such as o-rings are disposed on the outer surface of the first support member 90 for engagement with the polished bore 150 as further described below.

A second support member 79, such as a ring, is coupled to the plug 70, and may be supported by a shoulder of the second body 80. A releasable connection 75, such as one or more shear pins, dogs, or collets, is disposed through the second support member 79 and the plug 70. In this manner, the plug 70 is releasably secured to the first body 60. In one embodiment, the second support member 79 may be formed from a material harder than the material of the first body 60. One or more seals 71, such as o-rings, are disposed between the first body 60 and the plug 70.

Figure 4:
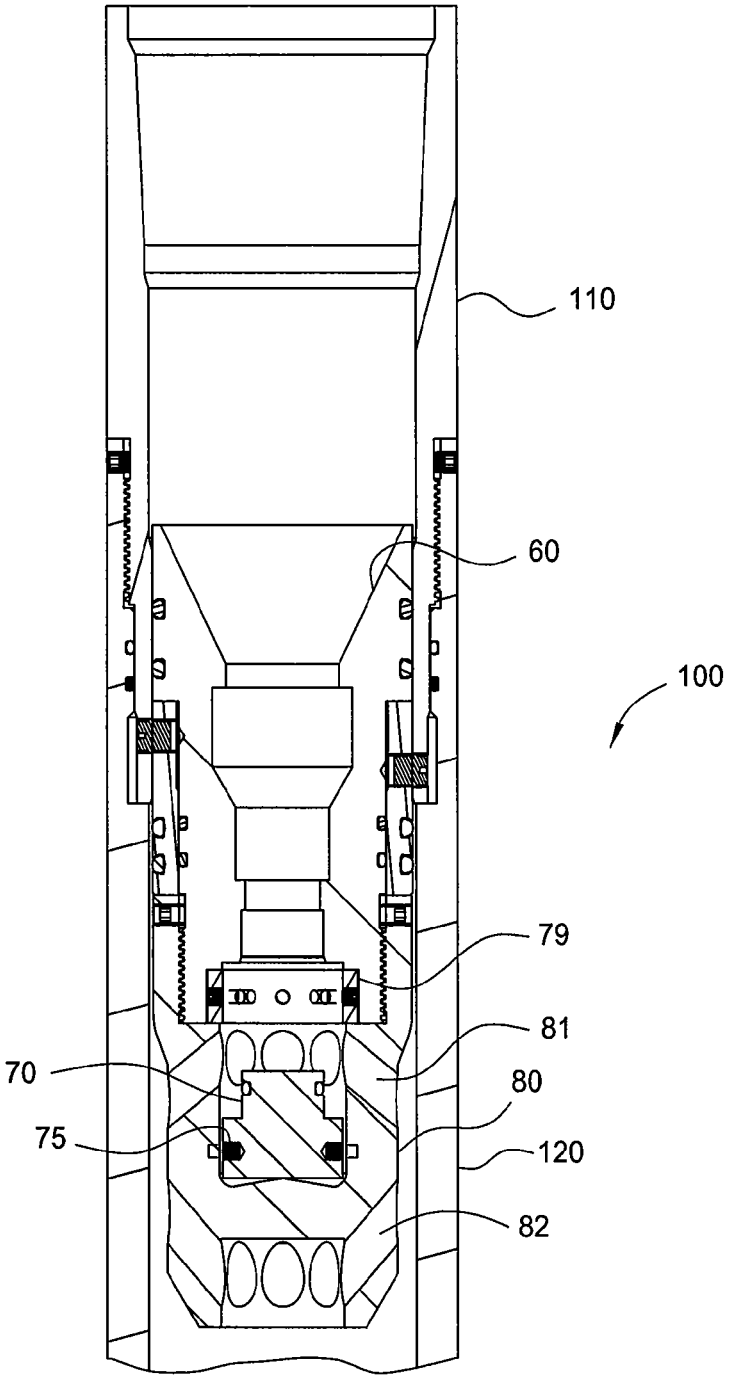

FIG. 4 illustrates the valve assembly 100 after release of the plug 70. When the system 1000 is in the desired position in the well 10, fluid may be supplied from the surface through the work string 20, the liner hanger 30, and/or any section of liner extending from the liner hanger 30, and onto the plug 70 at a pressure sufficient to release the releasable connection 75. The plug 70 may be moved in the bore of the second body 80 to open fluid communication with the flow paths 81, 82. In one embodiment, the flow paths 81 may be disposed through the second body 80 at an angle different (or opposite) than the flow paths 82. Fluid may be supplied into the chamber 50 to displace the gas out of the chamber 50. The gas may flow out through the first valve assembly 100 and up the work string 20, and/or may flow out through the second valve assembly 40 and into the well 10. The fluid flows through the second valve assembly 40 into the well 10, and may be circulated back to the surface to confirm that fluid communication has been established through the system 1000 and/or to condition the well 10 for subsequent operations.

Figure 5:
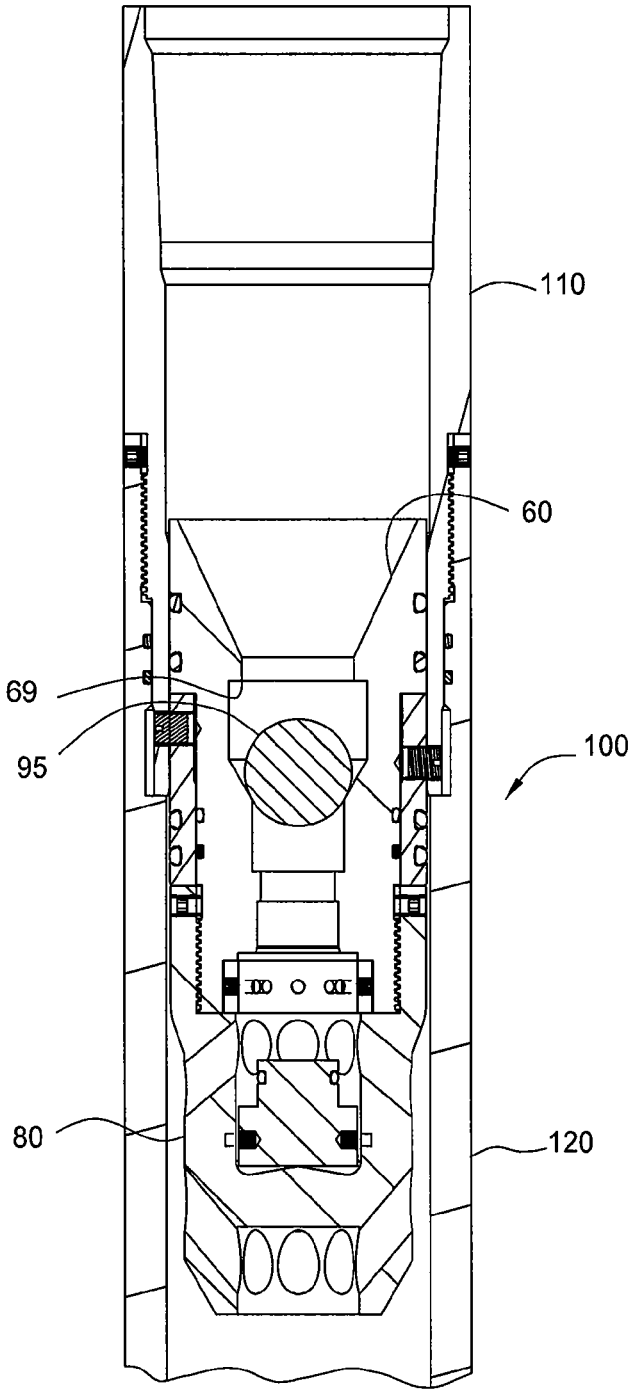

FIG. 5 illustrates a closure member 95, such as a ball, supplied from the surface engaging a seat portion of the first body 60 to close fluid communication through the bore of the first body 60. The closure member 95 may be pumped through the work string 20, the liner hanger 30, and/or any section of liner extending from the liner hanger 30. The first body 60 may include an inner shoulder 69 above the seat portion to capture and prevent the closure member 95 from moving out of the bore when pressure or fluid flow from above is reduced. The closure member 95 may seal fluid flow through first valve assembly 100 so that the system 1000 above the valve assembly 100 may be pressurized to conduct subsequent operations.

For example, the liner hanger 30 may be (at least partially) secured in the well 10 when the closure member 95 closes the valve assembly 100. In one embodiment, a setting tool on the work string 20 may expand the liner hanger 30 into engagement with the cased portion 15 (illustrated in FIG. 1) of the well 10. In one embodiment, one or more setting members, such as slips, anchors, packers, seals, and/or expansion devices, may be hydraulically and/or mechanically actuated to secure the liner hanger 30 into engagement with the cased portion 15 (illustrated in FIG. 1) of the well 10.

Figure 6:
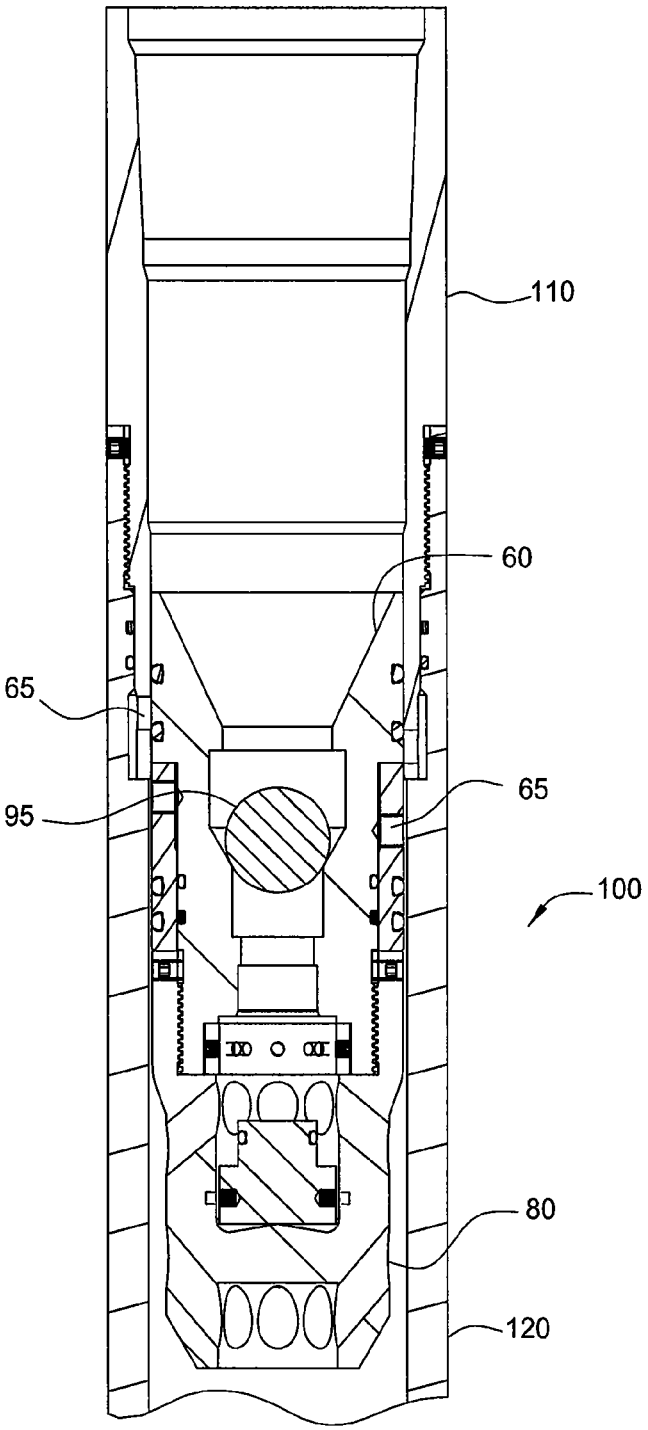

FIG. 6 illustrates the valve assembly 100 after release of the first body 60 from the upper mandrel 110. When the liner hanger 30 is in the desired position, and/or when the liner 130 (or system 1000) is moved to the bottom of the well 10, fluid may be supplied from the surface through the work string 20, the liner hanger 30, and/or any section of liner extending from the liner hanger 30. The fluid may be supplied onto the first body 60 and/or the closure member 95 at a pressure sufficient to release the releasable connection 65. The valve assembly 100 then may be pumped through the liner 130.

Figure 7:
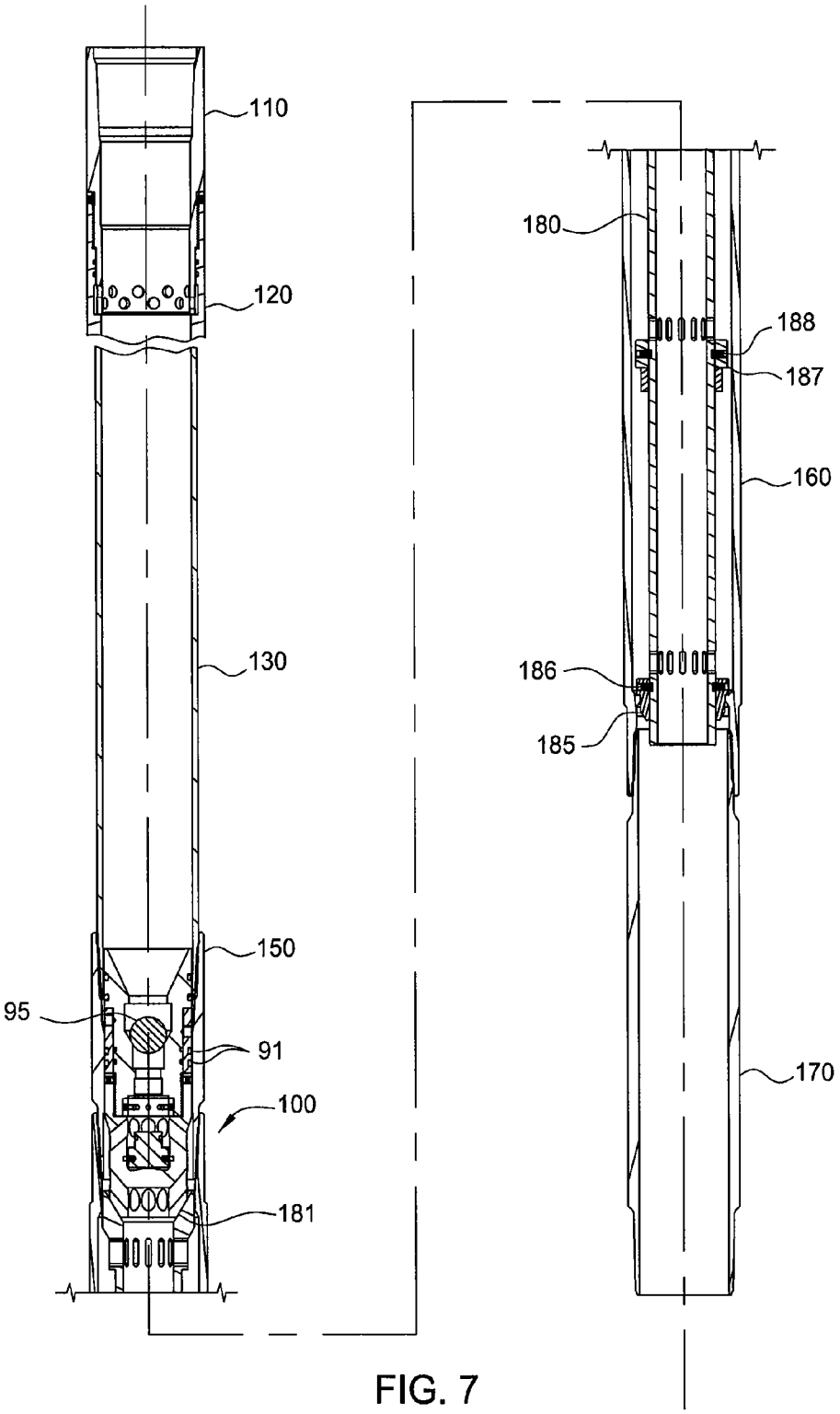
FIG. 7-10 illustrate sectional views of the liner flotation system operation.

As illustrated in FIG. 7, the valve assembly 100 may be moved through the bores of the mandrel 120 and the liner 130, and into engagement with the polished bore 150 and/or landed on the sleeve 180. In particular, the seals 91 on the first support member 90 of the valve assembly 100 may seal against the inner surface of the polished bore 150. The second body 80 may also engage an upper end 181 of the sleeve 180 to prevent further movement. The valve assembly 100 may be released from the upper mandrel 110 and moved closer to the lower end of the system 1000 to prevent obstruction of fluid flow through the liner 130 for subsequent operations, such as cementing the liner 130 in the well 10. The valve assembly 100 may also be released and moved through the liner 130 to provide an indication at the surface that the liner 130 has an unobstructed fluid bore.

Figure 8:
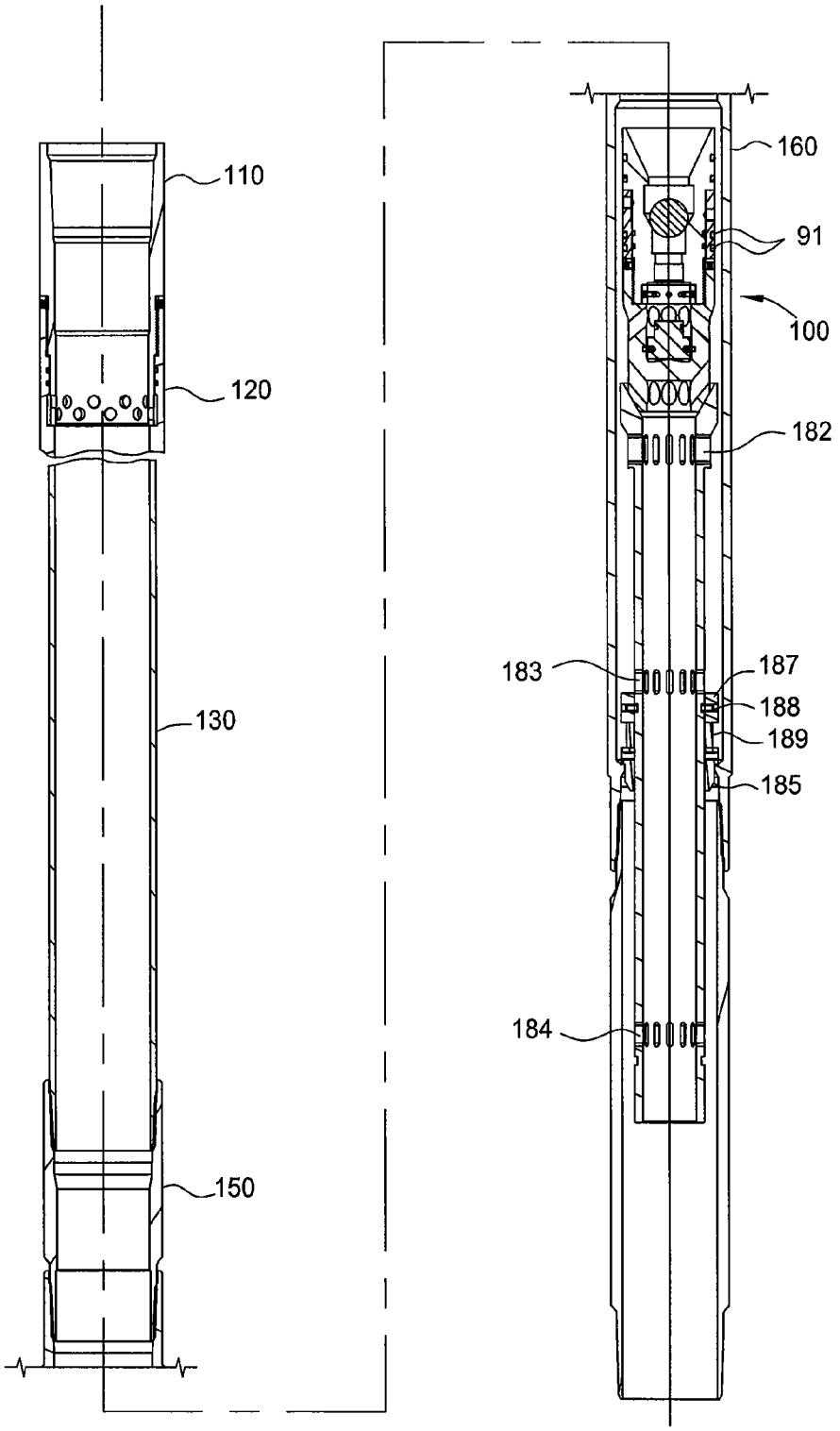

Referring to FIGS. 7 and 8, the sleeve 180 is coupled to the mandrel 160 by a releasable connection 186, such as one or more shear pins, dogs, or collets, disposed through the sleeve 180 and a first support member 185, such as a ring. The first support member 185 may be formed from a material harder than the material of the sleeve 180, and may engage a shoulder on the inner surface of the mandrel 160. A second support member 187, such as a ring, may be coupled to the mandrel 160 by a releasable connection 188, such as one or more shear pins, dogs, or collets. One or more flow paths 182, 183, 184, such as slots, may be formed through the body of the sleeve 180. One or more dampers 189, such as rubber shock absorbers, may be provided between the first and second support members 185, 187.

The sleeve 180 may be operable to provide one or more indications of fluid flow and valve positions in the system 1000, and may be operable to re-establish fluid flow through the system 1000 to form a wet shoe as further described below. When the valve assembly 100 engages and/or seals against the polished bore 150 and/or the sleeve 180, a pressure increase in the system 1000 may provide an indication at the surface that the valve assembly 100 has moved to the desired position. Prior to reaching the polished bore 150, however, fluid may flow around the valve assembly 100 as it is moving through the liner 130. In one embodiment, the valve assembly 100 may engage the sleeve 180 but not need form a sealed engagement with the sleeve 180 and/or the polished bore 150. The engagement between the valve assembly 100 and the sleeve 180 may provide a flow obstruction sufficient to increase pressure in the system to provide an indication at the surface that the valve assembly 100 has moved to the desired position. When the position of the valve assembly 100 has been verified at the surface, fluid circulation through the system 1000 may be reestablished through the sleeve 180.

Pressurized fluid may be applied to the valve assembly 100 and the sleeve 180 at a force sufficient to release the releasable connection 186. The sleeve 180 may then move relative to the first support member 185 and the mandrel 160. The sleeve 180 may move to a position where the second support member 187 engages the first support member 185. The dampers 189 may be provided to cushion or absorb any forces applied to the second support member 187 when engaging the first support member 185. Movement of the sleeve 180 also allows the first valve assembly 100 to move out of sealed engagement with the polished bore 150. Fluid may then flow around the valve assembly 100 and into the bore of the sleeve 180 via the flow paths 82 of the second body 80 and/or the flow paths 182, 183 of the sleeve 180. The reduction in pressure and/or the circulation of fluid flow into the well 10 provides another indication at the surface of the position of the valve assembly 100 and the sleeve 180, and that fluid communication through the system 1000 is open to conduct subsequent operations.

In one embodiment, the liner hanger 30 may be secured into engagement with the cased portion 15 of the well 10. The work string 20 may release the liner hanger 30 and the system 1000 in the well 10, and may be removed from the well 10. In one embodiment, another work string may be lowered into the well 10 and into engagement with the liner hanger 30 and/or system 1000 to conduct subsequent operations.

Figure 9:
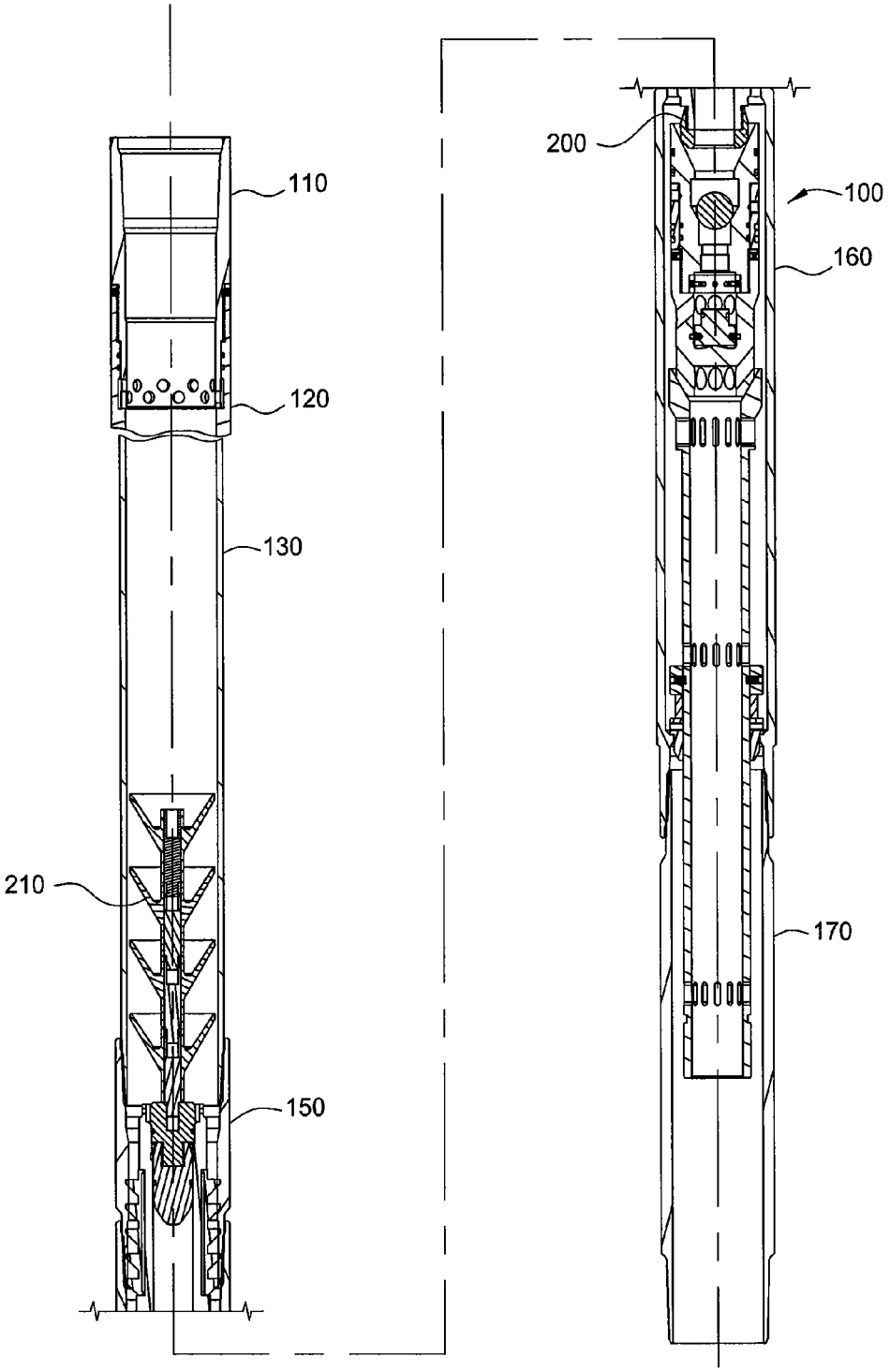

FIG. 9 illustrates the system 1000 after a cementing operation. Cement may be supplied through the work string 20 (or the well 10 if the work string 20 is removed) behind a first plug 200 and ahead of a second plug 210. The first and second plugs 200, 210 may be any conventional cement/wiper plugs used in well cementing operations known in the art. In one embodiment, the first plug 200 may be pumped through the work string 20 and engage a setting or running tool coupled to the work string 20, the work string 20, the liner hanger 30, or a section of liner extending from the liner hanger 30. In one embodiment, the first plug 200 may be releasably coupled to the work string 20, a setting or running tool coupled to the work string 20, the liner hanger 30, or a section of liner extending from the liner hanger 30 during run-in of the system 1000. Cement may be supplied at a pressure sufficient to rupture the first plug 200 (if necessary) and permit fluid flow through the work string 20, the liner hanger 30, a section of liner extending from the liner hanger 30, the liner 130, the valve assembly 100, the sleeve 180, and the second valve assembly 40 into the well 10. The cement may flow around the valve assembly 100 and into the bore of the sleeve 180 via flow paths 82 in the second body 80 and/or the flow paths 182 of the sleeve 180. The second valve assembly 40 permits the flow of cement into the well 10 and prevents fluid flow back into the system 1000.

A predetermined amount of cement may be supplied into the well 10 to cement the system 1000 therein. The second plug 210 may be pumped through the work string 20 and may engage the first plug 200 to seal fluid flow. Fluid may be supplied through the work string 20 at a pressure sufficient to release the first and second plugs 200, 210 and pump them to the polished bore 150. As illustrated in FIG. 9, the first plug 200 may engage the first valve assembly 100 and the polished bore 150 to seal fluid flow. The pressure increase in the system 1000 may provide an indication at the surface that the first and second plugs 200, 210 are in the desired position.

Figure 10:
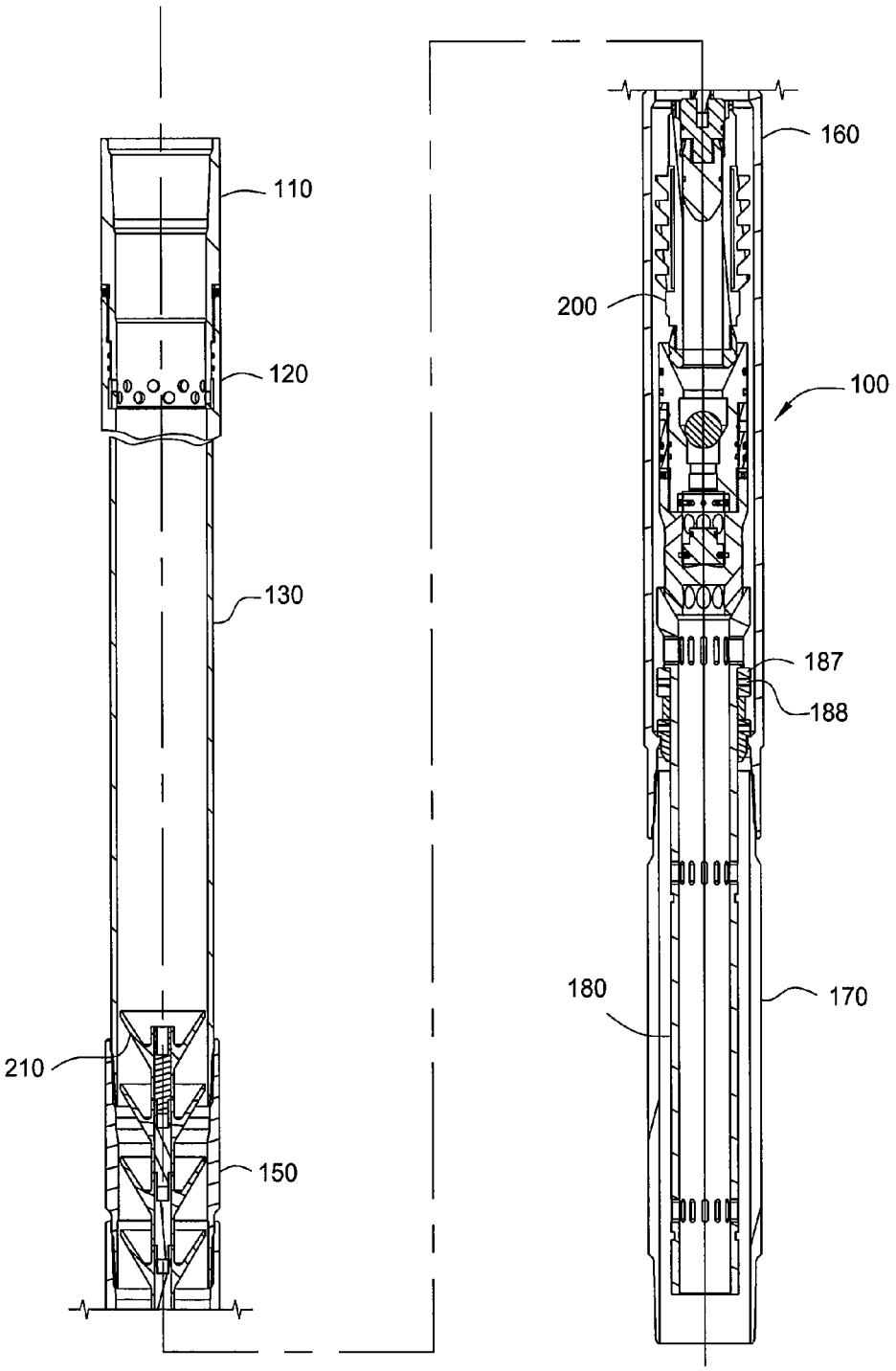

FIG. 10 illustrates the system 1000 after fluid flow is re-established to form a "wet shoe" with the second valve assembly 40. A wet shoe occurs when cement does not set around the second valve assembly 40 so that fluid may continue to be flowed through the second valve assembly 40 after the system 1000 is cemented in the well 10. Fluid is supplied onto the first and second plugs 200, 210, the valve assembly 100, and/or the sleeve 180 at a pressure sufficient to release the releasable connection 188. The sleeve 180 may then move relative to the second support member 187 to a position where an upper shoulder of the sleeve 180 engages the second support member 187. Movement of the sleeve 180 also allows the first plug 200 to move out of sealed engagement with the polished bore 150. Fluid may then flow around the first and second plugs 200, 210, the valve assembly 100 and into the bore of the sleeve 180 via the flow paths 82 of the second body 80 and/or the flow paths 182 of the sleeve 180. The reduction in pressure and/or the circulation of fluid flow into the well 10 provides another indication at the surface of the position of the first and second plugs 200, 210, the valve assembly 100, and the sleeve 180, and that fluid communication through the system 1000 is open to conduct subsequent operations.

In one embodiment, a fluid such as water may be supplied through the wet shoe system 1000 into the well 10. In one embodiment, a perforating device may be pumped through the wet shoe system 1000 on a wireline to perforate one or more sections of the well 10. In one embodiment, a plugging device may be pumped through the wet shoe system 1000 on a wireline to seal one or more sections of the well 10. In one embodiment, a perforating, fracturing, and/or another liner hanging operation may be conducted with the system 1000.

While the foregoing is directed to embodiments of the invention, other and further embodiments of the invention may be devised without departing from the basic scope thereof, and the scope thereof is determined by the claims that follow.

The invention claimed is:

1. A liner flotation system, comprising:

a liner;

a first valve and a second valve configured to form a chamber in the liner, the first valve operable to allow fluid flow into the chamber, and the second valve operable to allow fluid flow out of the chamber; and a releasable sleeve disposed in the chamber, wherein the first valve is movable into engagement with the releasable sleeve to provide an indication of a position of the first valve.

2. The system of claim 1, wherein the first valve includes a body and a plug operable to temporarily prevent fluid flow through a bore of the body.

3. The system of claim 2, wherein the plug is releasably coupled to a support member that is secured to the body, and wherein the support member is formed from a material harder than a material of the body.

4. The system of claim 2, wherein the bore of the body includes a seat portion for engagement with a closure member to close fluid flow through the bore.

5. The system of claim 4, wherein the bore of the body includes an inner shoulder to prevent the closure member from moving out of the bore.

6. The system of claim 1, wherein the body is secured in a mandrel that is in fluid communication with the liner.

7. The system of claim 6, wherein the body is secured in the mandrel by a support member that is releasably coupled to the mandrel, and wherein the support member is formed from a material harder than a material of the body.

8. The system of claim 1, further including a polished bore that is in fluid communication with the liner, wherein the first valve is moveable through the liner and into sealed engagement with the polished bore.

9. The system of claim 8, wherein the releasable sleeve is releasably coupled to a support member that is secured in a mandrel that is in fluid communication with the liner.

10. The system of claim 9, wherein the releasable sleeve is released from the support member to enable movement of the first valve out of sealed engagement with the polished bore.

11. The system of claim 10, wherein the releasable sleeve is releasably coupled to a second support member that is movable into engagement with the first support member.

12. The system of claim 10, wherein the releasable sleeve includes one or more flow paths in communication with a bore of the releasable sleeve.

13. The system of claim 1, wherein the second valve permits fluid flow out of the chamber and prevents fluid flow into the chamber.

14. The system of claim 1, further including a liner hanger operable to secure the liner in a well.

15. The system of claim 1, wherein the chamber is filled with a material having a density less than a density of fluids surrounding the chamber when positioned in a well.

16. The system of claim 1, wherein the chamber is filled with at least one of a gas, a liquid, and a solid.

17. A method of securing a liner in a well, comprising:

lowering a liner having a chamber into the well;

actuating a valve to open fluid flow into the chamber;

supplying a fluid into the chamber;

releasing and moving the valve into engagement with a sleeve disposed in the chamber to provide an indication of a position of the valve; and releasing and moving the sleeve with the valve to open fluid communication through the sleeve.

18. The method of claim 17, further comprising securing the liner in the well and supplying cement through the liner and into the well.

19. The method of claim 18, further comprising supplying a cement plug into engagement with one of the liner, the first valve, and the sleeve to provide an indication of the position of the cement plug.

20. The method of claim 19, further comprising releasing and moving the sleeve with the cement plug to open fluid communication through the sleeve.

21. The method of claim 20, further comprising forming a wet shoe for conducing subsequent well operations after cementing the liner in the well.

22. The method of claim 17, wherein the chamber is filled with a material having a density less than a density of fluids in the well.

23. The method of claim 17, wherein the chamber is filled with at least one of a gas, a liquid, and a solid.

24. The method of claim 17, wherein the liner is more buoyant than fluids in the well.

* * * * *

UNITED STATES PATENT AND TRADEMARK OFFICE

CERTIFICATE OF CORRECTION

PATENT NO. : 9,279,295 B2
APPLICATION NO. : 13/536078
DATED : March 8, 2016
INVENTOR(S) : Williamson et al.

It is certified that error appears in the above-identified patent and that said Letters Patent is hereby corrected as shown below:

In the Claims:

Column 8, Claim 19, Line 27, please delete "first".

Signed and Sealed this
Seventeenth Day of May, 2016

Michelle K. Lee

Michelle K. Lee
*Director of the United States Patent and Trademark Office*